United States Patent [19]

Tahata

[11] Patent Number: 4,615,845

[45] Date of Patent: Oct. 7, 1986

[54] VARIABLE VENTURI TYPE CARBURETOR AND ASSOCIATED METHOD

[75] Inventor: Michio Tahata, Niiza, Japan

[73] Assignee: Honda Giken Kogyo Kabushiki Kaisha, Tokyo, Japan

[21] Appl. No.: 724,522

[22] Filed: Apr. 18, 1985

[30] Foreign Application Priority Data

Apr. 25, 1984 [JP] Japan ..... 59-83230

[51] Int. Cl.[4] ..... F02M 9/06

[52] U.S. Cl. ..... 261/44 B; 261/52

[58] Field of Search ..... 261/44 B, 52

[56] References Cited

U.S. PATENT DOCUMENTS

| | | | |
|---|---|---|---|
| 1,375,898 | 4/1921 | Ciglia et al. | 261/52 |
| 2,047,661 | 7/1936 | Arff | 261/52 |
| 2,694,558 | 11/1954 | Jorgensen et al. | 261/52 |
| 3,576,315 | 4/1971 | Sutton | 261/39 D |
| 3,669,636 | 6/1972 | Garretson et al. | 261/52 |
| 3,898,967 | 8/1975 | Bennett et al. | 261/39 E |
| 3,906,911 | 9/1975 | Nakada et al. | 261/52 |
| 3,920,777 | 11/1975 | Harrison et al. | 261/52 |
| 3,952,076 | 4/1976 | Chatelain et al. | 261/DIG. 19 |
| 4,053,449 | 10/1977 | Yoshioka et al. | 261/52 |
| 4,159,290 | 6/1979 | Honma et al. | 261/52 |
| 4,250,125 | 2/1981 | Donovan | 261/44 B |
| 4,264,536 | 4/1981 | Yoshioka et al. | 261/39 D |
| 4,371,478 | 2/1983 | Wada | 261/44 C |

*Primary Examiner*—Tim Miles

*Attorney, Agent, or Firm*—Roberts, Spiecens & Cohen

[57] ABSTRACT

A variable venturi type carburetor comprising a carburetor body provided with a suction passage therein, a slide valve supported by the body for movement across the suction passage to function as a variable venturi and a butterfly throttle valve pivotably supported by the carburetor body downstream of the slide valve. An interlocking mechanism connects the slide valve and the butterfly throttle valve for operation in correspondence with one another and the interlocking mechanism is arranged in a housing chamber formed in a side portion of the carburetor body. The interlocking mechanism includes a regulator member which is accessible from outside the housing chamber.

13 Claims, 10 Drawing Figures

VARIABLE VENTURI TYPE CARBURETOR AND ASSOCIATED METHOD

FIELD OF THE INVENTION

This invention relates to a carburetor of variable venturi type and associated method of operation.

DESCRIPTION OF PRIOR ART

In conventional carburetors of variable venturi type a slide throttle valve capable of being moved slidingly across a suction passage is operated by a throttle wire. In such carburetor, the throttle slide valve is subjected to a force acting downstream, in the suction direction of air flow, due to the vacuum produced in the engine. Consequently, a relatively large frictional force is developed between the side surface of the slide throttle valve which faces in the downstream direction and the opposed surface of the carburetor body. Therefore, a relatively large tractive force is necessary to operate the throttle wire.

A variable venturi carburetor of so-called constant-vacuum type has also been developed in an effort to eliminate these deficiencies. In this carburetor the vacuum is controlled by means of a butterfly throttle valve provided in the suction passage and the slide throttle valve is opened and closed in accordance with the resulting vacuum. However, if the open degree of the butterfly throttle valve in this carburetor is increased suddenly, the vacuum does not increase accordingly. In consequence, the action of the slide throttle valve does not follow the sudden acceleration operation. Thus, this variable venturi type carburetor has a low acceleration response.

The present inventor has already proposed a variable venturi type carburetor in which the slide valve, which functions as a variable venturi, and the butterfly throttle valve are connected together via an interlocking mechanism so that these can be operated in correspondence. Since such interlocking mechanism is provided generally at a side portion of a carburetor body, it is exposed directly to the outside air. Therefore, it is desirable to prevent, as far as is possible, the development of rust on the interlocking mechanism, and thereby improve its durability.

SUMMARY OF THE INVENTION

An object of the present invention is to provide a variable venturi type carburetor having improved acceleration response, and of a construction to prevent the interlocking mechanism from being exposed directly to the outside air and thereby improve its durability.

According to the present invention, a slide valve is adapted to be moved slidingly across a suction passage in a carburetor body to function as a variable venturi, and a butterfly throttle valve is supported pivotably on the carburetor body downstream of the slide valve in the suction passage. The slide valve and the butterly throttle valve are connected together via an interlocking mechanism so that these valves can be operated correlatively, the interlocking mechanism being arranged in a housing chamber provided at a side portion of the carburetor body.

Since the slide valve and the butterfly throttle valve are connected together via the interlocking mechanism, the acceleration response of the slide valve can be improved. Moreover, the interlocking mechanism, which is arranged in the housing chamber, is not exposed directly to the outside air, so that the durability of the mechanism can be improved.

DETAILED DESCRIPTION OF PREFERRED EMBODIMENTS

Figure 1:
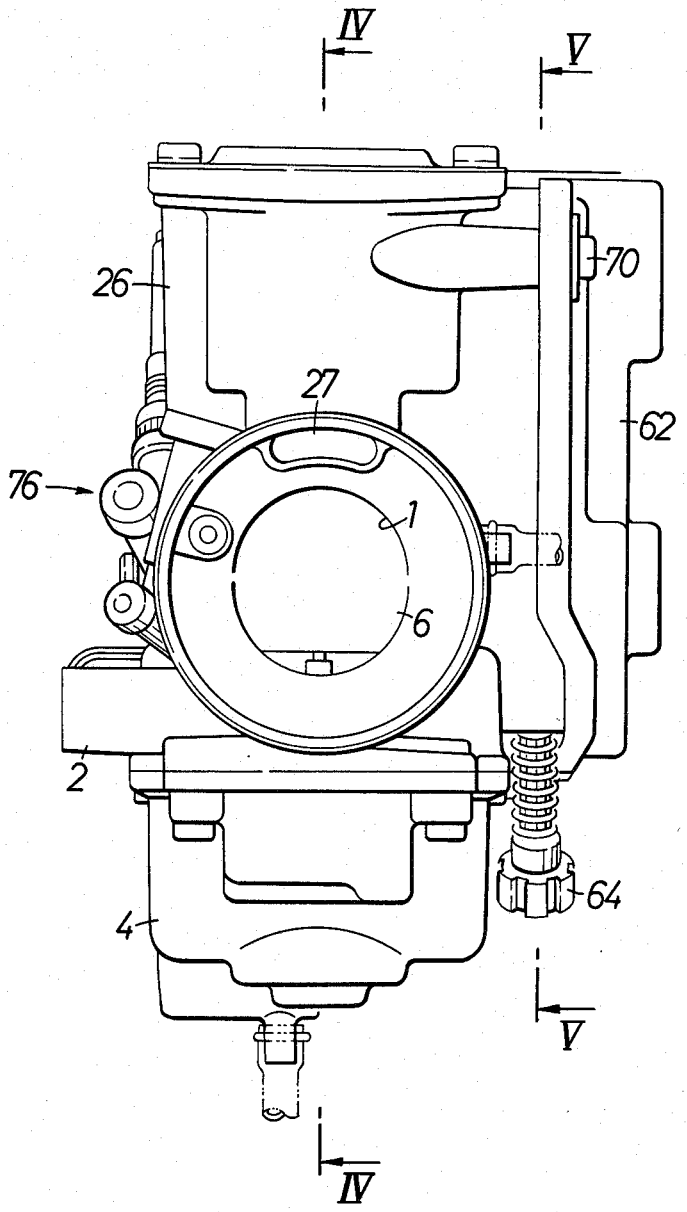
FIG. 1 is a front elevational view of a carburetor according to a first embodiment of the invention.
Figure 2:
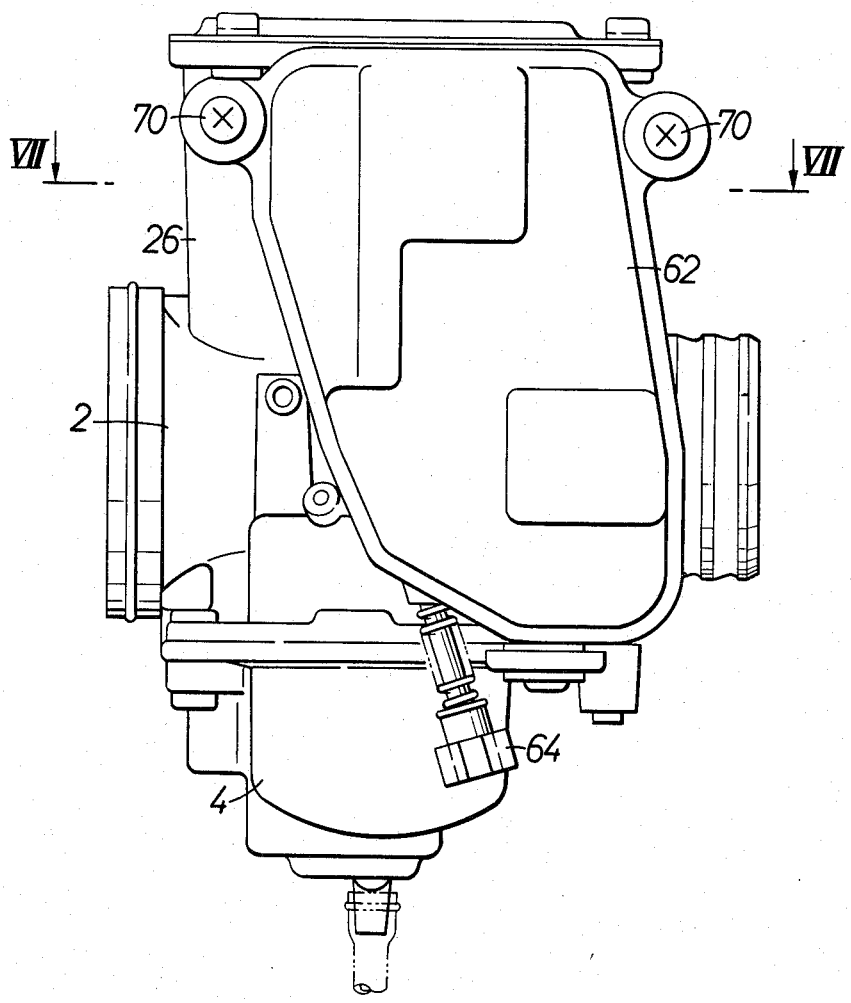
FIG. 2 is a right side elevational view of the carburetor of FIG. 1.

Embodiments of the present invention will now be described with reference to the drawing. First, referring to FIGS. 1–4 which illustrate a first embodiment of the present invention, a float chamber body 4 forming a float chamber 3 is secured via a seal member 5 to a lower portion of a carburetor body 2 in which a suction passage 1 is formed. In suction passage 1 is a slide valve 6 adapted to be moved slidingly across the suction passage 1, and a butterfly throttle valve 7 pivotably supported by the carburetor body 2 on the downstream side of the slide valve 6 with respect to the direction of air flow 8, i.e., the suction direction. The slide valve 6 and the butterfly throttle valve 7 are operated correlatively from their fully-closed positions to their fully-opened positions.

The carburetor body 2 is provided with an intermediate and high speed main fuel nozzle 10 which opens at the inner surface of the suction passage 1. An air bleeder pipe 11 is connected to a lower portion of the main fuel nozzle 10 integrally and concentrically. A main fuel jet 12 extending under the fuel level in the float chamber 3 is joined to a lower portion of the air bleeder pipe 11. Thus, a main fuel passage Mw extending from the main fuel jet 12 to the main fuel nozzle 10 via the air bleeder pipe 11 is formed. The main fuel passage Mw opens into the suction passage 1 just under the slide valve 6. An annular chamber 17 formed around the air bleeder pipe 11 is in communication with an upstream end of the suction passage 1 via an air bleeder passage (not shown).

The carburetor body 2 is further provided with a low speed fuel passage Sw which opens into the suction passage 1 in the vicinity of the butterfly throttle valve 7. A pilot outlet 18, which opens into the suction passage 1 on the slightly downstream side of the butterfly throttle valve 7, and a low speed fuel nozzle 19, which opens into the suction passage 1 on the slightly upstream side of the butterfly throttle valve 7 in its fully-closed position are also provided in the carburetor body 2. The pilot outlet 18 and the fuel nozzle 19 are in communication with a fuel passage 20. A low speed fuel jet 21, which extends under the fuel level in the float chamber 3, is connected to the fuel passage 20 via an air bleeder pipe 22. In order to regulate the degree of opening of the pilot outlet 18, a pilot screw 23 is engaged with the carburetor body 2 so that the pilot screw 23 can be turned to advance upwardly and downwardly.

The carburetor body 2 is further provided, at its lower portion, with a low and intermediate speed primary fuel nozzle 28 which opens into the suction passage 1 between the slide valve 6 and the butterfly throttle valve 7. An air bleeder pipe 29 is connected to a lower portion of the primary fuel nozzle 28 integrally and concentrically. A primary fuel jet 30 which extends under the fuel level in the float chamber 3 is joined to a lower portion of the air bleeder pipe 29. An annular chamber 31 formed around the air bleeder pipe 29 is in communication with an upstream end of the suction passage 1 via an air bleeder passage (not shown).

A float 13 is housed in the float chamber 3. A float valve 14 is engaged with a pivotably supported portion of the float 13 so as to open and close a valve port 16 in accordance with vertical movement of the float 13. The valve port 16 is in communication with a fuel supply passage 15 formed in the carburetor body 2.

A guide cylinder 24 extends upwardly at an upper portion of the carburetor body 2 at a location opposite the main fuel nozzle 10. The guide cylinder is integral with the carburetor body 2. A housing 26 forming an air chamber 25 is integrally joined to an upper portion of the guide cylinder 24. The air chamber 25 is in communication with an upstream end of the suction passage 1 via a passage 27.

The slide valve 6 is formed in the shape of an open top, closed bottom cylinder, and the valve 6 is fitted slidably in the guide cylinder 24. A needle valve 34 is secured to the bottom of the slide valve 6 and is inserted into the main fuel nozzle 10. An upwardly extending recess 32 is provided in the lower end surface of the slide valve 6 and an inverted cutaway 33 is formed in the side surface at the bottom of slide valve 6 on the downstream side with respect to the suction direction 8. The recess 32 thus provided causes turbulence to occur in the air flow therein, so that the vacuum applied to the main fuel nozzle 10 can be made uniform. The cutaway 33 enables the vacuum in the space between the bottom portion of the slide valve 6 and the inner surface of the wall of the suction passage 1, i.e., a venturi portion, to increase. Consequently, the discharge rate of fuel from the main fuel nozzle 10 increases, and the regulation of the air-fuel ratio can be easily effected.

A shaft 43 which extends parallel to a valve shaft 39 of the butterfly throttle valve 7 is pivotably supported in the housing 26, and a driving arm 44 is connected fixedly at one end thereof to the pivotable shaft 43 in the air chamber 25. A bracket 45 is connected fixedly to the slide valve 6. The bracket 45 is also connected at the other end thereof to the other end of the driving arm 44 by a connecting rod 46. Accordingly, reciprocating pivotal movements of the pivotable shaft 43 are converted into linear reciprocating movements of the slide valve 6 along the guide cylinder 24, i.e., the opening and closing movements of the slide valve 6, via the driving arm 44, connecting rod 46 and bracket 45.

Figure 5:
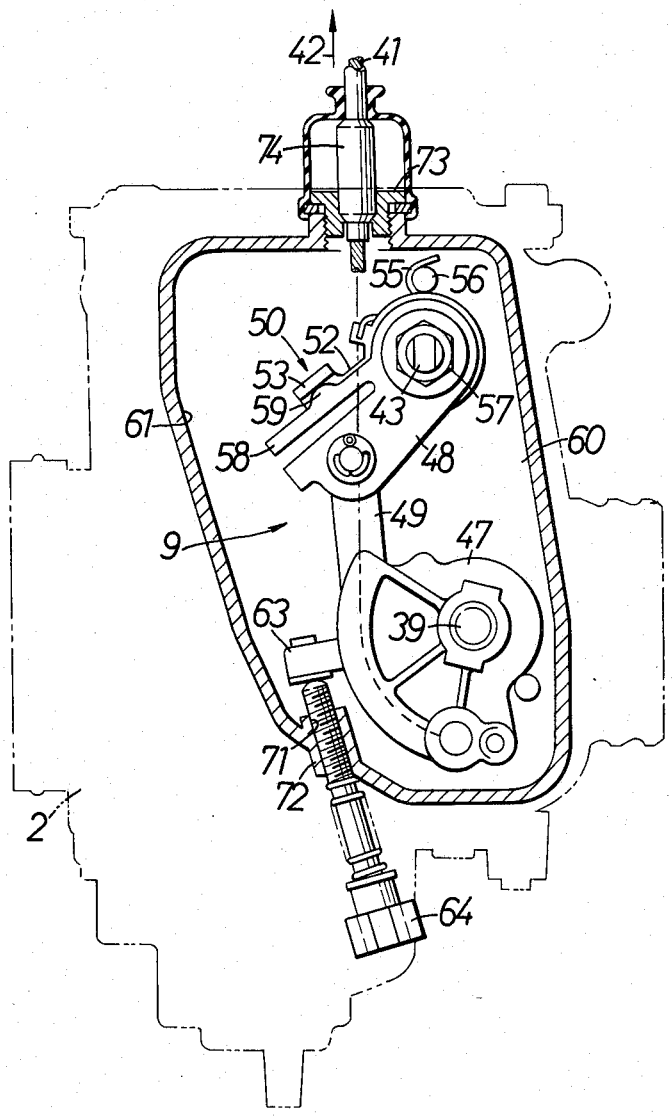
FIG. 5 is a sectional view taken along line V—V in FIG. 1.
Figure 6:
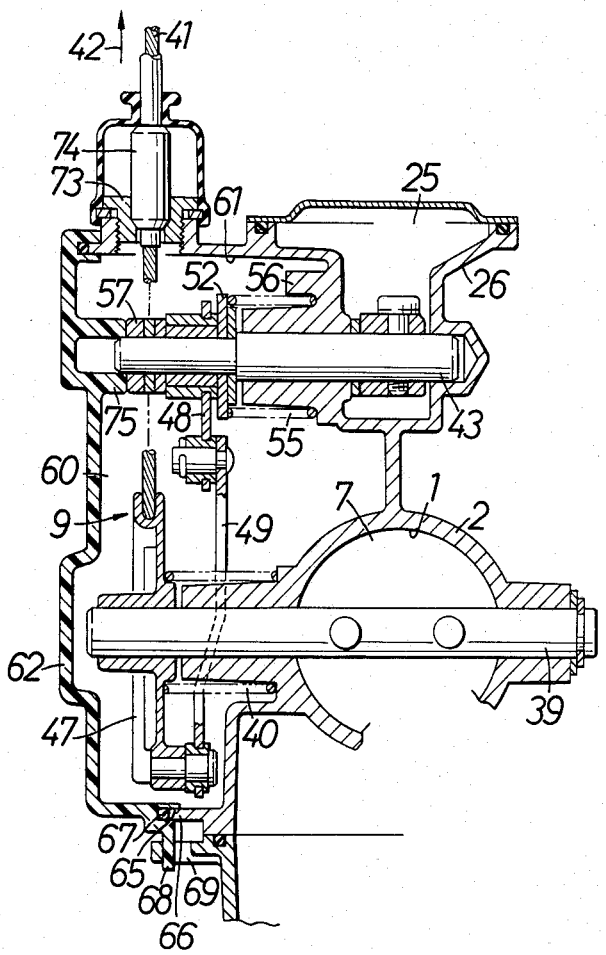
FIG. 6 is a front elevational view, in section, of a principal portion of the interior of the housing chamber of the carburetor.
Figure 7:
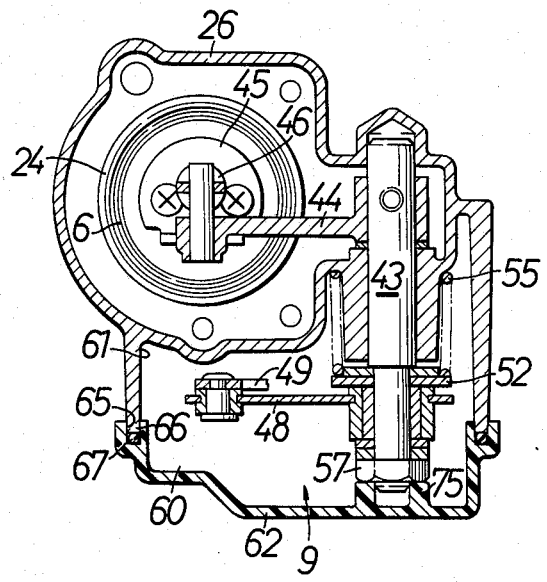
FIG. 7 is a sectional view taken along line VII—VII in FIG. 2.

Referring to FIGS. 5–7, the valve shaft 39 of the butterfly throttle valve 7 and the pivotable shaft 43 are connected together via an interlocking mechanism 9 so as to correlate the opening and closing actions of the slide valve 6 with those of the butterfly valve 7. The interlocking mechanism 9 is arranged in a housing chamber 60 provided at a side portion of the carburetor body 2. The housing chamber 60 is defined by a wall of a housing recess 61 provided at a side portion of the carburetor body 2, and a cover member 62 fastened to the carburetor body 2 so as to close the housing recess 61.

The interlocking mechanism 9 consists of a throttle lever 47 press-fitted firmly around an end portion of the valve shaft 39, a pivotable arm 48 mounted on an end portion of the pivotable shaft 43, and a connecting arm 49 fixed at one end to the pivotable arm 48 and joined at the other end thereof to the portion of the throttle lever 47 which is remote from the axis thereof. A regulator mechanism 50 is interposed between the pivotable arm 48 and the pivotable shaft 43. A throttle wire 41 is connected to the throttle lever 47. When the throttle wire 41 is drawn in the direction of arrow 42, the butterfly throttle valve 7 is turned in the opening direction. The butterfly throttle valve 7 is urged in the closing direction by a coil spring 40 so that when the tractive force of the throttle wire 41 is decreased, the butterfly throttle valve 7 is turned in the closing direction. The opening and closing actions of the butterfly throttle valve 7 are transmitted to the pivotable shaft 43 via the interlocking mechanism 9 and the regulator mechanism 50 so that the slide valve 6 is opened or closed in accordance with the pivotal movement of the shaft 43.

The regulator mechanism 50 consists of a lever 52 which is mounted on an end portion of the pivotable shaft 43 so that the lever 52 is angularly fixed on the shaft 43 and extends in the same direction asthe pivotable arm 48, a projection 53 provided on the lever 52, and a coil spring 55 urging the lever 52 to turn in the direction in which the projection 53 comes into contact with the pivotable arm 48. The coil spring 55 is fitted around the pivotable shaft 43 and is engaged at one end with an integral pin 56 in the housing 26, and at the other end with the lever 52. The pivotable arm 48 is fitted at its base portion around the pivotable shaft 43 so that the arm 48 can be turned relative to the shaft 43. A setting nut 57 is fixedly secured at an end of the pivotable shaft 43 so as to prevent the pivotable arm 48 from coming off from the shaft 43. The pivotable arm 48 is provided with a contact arm 58 which is capable of regulating the circumferential distance between the arm 58 and the portion of the pivotable arm 48 to which the connecting arm 49 is joined. The contact arm 58 is provided with a projection 59 engageable with the projection 53.

In the interlocking mechanism 9 and the regulator mechanism 50, which are formed as described above, the operation of the throttle lever 47 for opening the butterfly throttle valve 7, i.e., clockwise pivotal movement in FIG. 5 of the lever 47, is transmitted to the pivotable arm 48 to cause the arm 48 to turn clockwise. Since the projection 53 in the regulator mechanism 50 is engaged resiliently with the projection 59 of the pivotable arm 48, the lever 52 and the shaft 43 are turned clockwise The pivotal movement of the shaft 43 is transmitted to the slide valve 6 via the driving arm 44, connecting rod 46 and bracket 45, so that the slide valve 6 is displaced upwardly along the guide cylinder 24, i.e., moved in the opening direction.

Conversely, when the butterfly throttle valve 7 is turned counterclockwise in FIG. 5, the pivotable arm 48 is also turned counterclockwise. In accordance with the counterclockwise movement of the pivotable arm 48 the lever 52, i.e., the pivotable shaft 43 turns counterclockwise by the resilient force of the coil spring 55 as the projection 53 follows the projection 59 in a contacting state. Consequently, the slide valve 6 is forced downwardly via the driving arm 44, connecting rod 46 and bracket 45, i.e., moved in the closing direction. At this time, the pivotable arm 48 can be turned counterclockwise by the regulator mechanism 50. Therefore, the butterfly throttle valve 7 can be closed irrespective of the movement of the slide valve 6.

The regulator mechanism 50 is capable of finely regulating the degree of opening of the slide valve 6 with respect to that of the butterfly throttle valve 7 by regulating the distance between the portion of the pivotable arm 48 to which the connecting arm 49 is joined and the contact arm 58. Since the projection 53 resiliently engages the projection 59, any vibration of the throttle lever 47, pivotable arm 48 and connecting arm 49, due to mounting errors is damped so that the interlocking mechanism is operated smoothly.

The throttle lever 47 is provided with a limit projection 63 extending laterally therefrom. A stop screw 64, serving as an adjusting screw member, is engaged with the limit projection 63 to determine a fully closed position of the throttle lever 47. Accordingly, when the stop screw 64 is turned forwardly or backwardly, the fully closed position of the butterfly throttle valve 7 can be finely regulated.

Referring next to FIGS. 5 and 7, the valve shaft 39 and the pivotable shaft 43 are supported on the portions of the carburetor body 2 and housing 26 which are away from the guide cylinder 24. Thus, dead spaces are formed in the portions of the interior of the housing chamber 60 which are around the valve shaft 39 and pivotable shaft 43. The coil springs 40,55 are mounted in these dead spaces. This enables the minimization of the lengths of the portions of the valve shaft 39 and pivotable shaft 40 which project from the carburetor body 2 and the housing 26, respectively. Accordingly, the carburetor as a whole can be made compact.

The cover member 62 is formed in the shape of a box of a flexible synthetic resin, and is provided with a locking groove 65 in a free edge thereof. A locking projection 66 which is engageable in the locking groove 65 is formed on a free edge of the wall defining the housing recess 61 which is formed on the carburetor body 2. The cover member 62 can be fastened to the carburetor body 2 by engaging the locking projection 66 in the locking groove 65 resiliently via a seal member 67. Therefore, the cover member 62 can be fastened to the carburetor body 2 easily, and the integrity of the seal of the locking portions thereof can be assured.

The cover member 62 is further provided at its lower end with a locking projection 68, which is engageable in a locking bore 69 provided in the carburetor body 2. When the locking projection 68 is engaged in the locking bore 69, the cover member 62 is pivotably supported at its lower portion on the carburetor body 2. When the upper portion of the cover member 62 is pressed against the carburetor body 2, the locking projection 66 is engaged in the locking groove 65. The cover member 62 can thus be fastened to the carburetor body 2 very easily. After the cover member 62 is engaged with the carburetor body 2, the upper portion of the cover member is securely tightened to the carburetor body 2 by screws 70. As a result the cover member 62 is reliably fixed to the carburetor body 2.

The portion of the wall of the housing chamber 60 which defines the housing recess 61 is provided with an integral boss 72 which has a threaded bore 71 therein. The stop screw 64 is threadably engaged in the threaded bore 71 in the boss 72 so that the stop screw 64 can be advanced forwardly and backwardly therein. Accordingly, the degree of opening of the butterfly throttle valve 7 can be finely regulated by turning the stop screw 64 forwardly or backwardly from outside of the housing chamber 60.

A cap 73 is screwed onto an upper portion of the wall of the housing recess 61. An end portion of an outer wire 74 is inserted and fixed in the cap 73. The throttle wire 41 which can be moved in the outer wire 74 is connected to the throttle lever 47 in the housing chamber 60. The throttle wire 41 is thus supported by the wall which forms the housing chamber 60. This makes it unnecessary to provide a special stay for supporting the throttle wire 41. A loosening-preventing portion 75 is formed integrally with the cover member 62 so that the portion 75 extends inwardly from that portion of the cover member 62 which is opposed to an end portion of the pivotable shaft 43. The loosening-preventing portion 75 is engaged with the setting nut 57 so as to prevent the setting nut 57 from being loosened and coming off the pivotable shaft 43.

Figure 3:
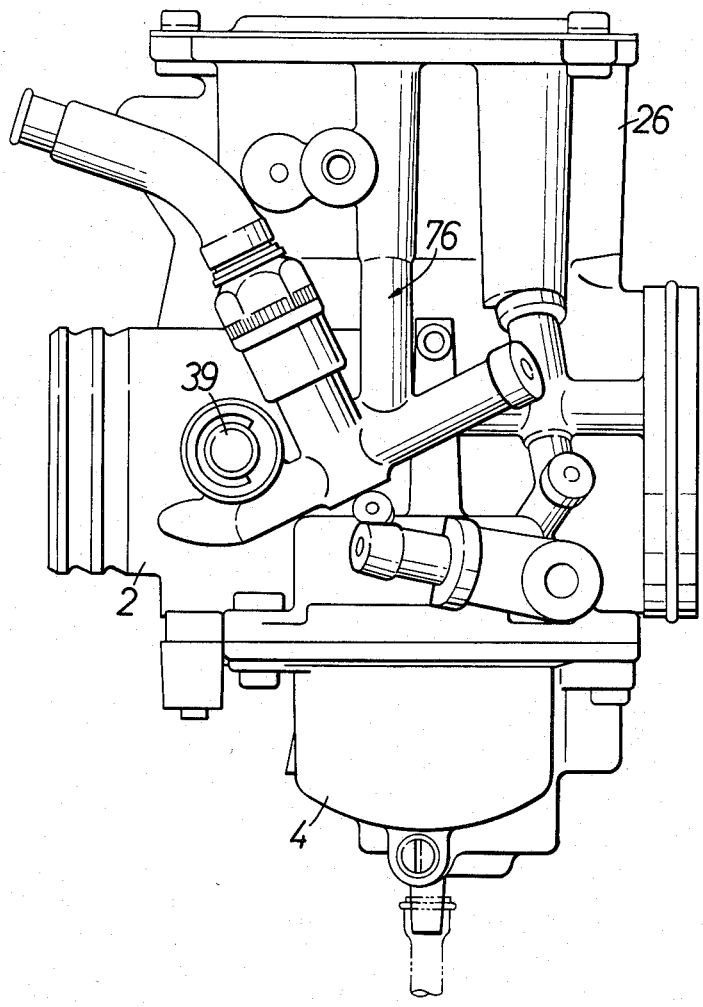
FIG. 3 is a left side elevational view of the carburetor of FIG. 1.
Figure 4:
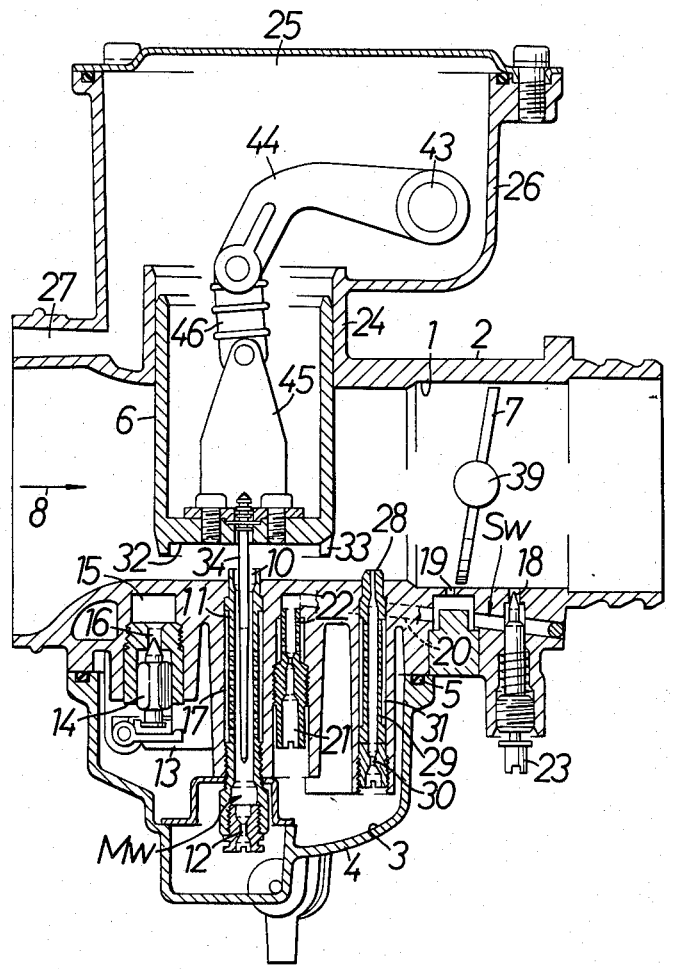
FIG. 4 is a sectional view taken along line IV—IV in FIG. 1.

Referring especially to FIG. 3, a bypass type starting fuel supply means 76 is provided at the side portion of the carburetor body 2 which is on the opposite side of the side portion thereof at which the interlocking mechanism 9 is provided. Since the interlocking mechanism 9 and the bypass type starting fuel supply means 76 are thus provided in a separate manner at both sides of the carburetor body 2, the carburetor as a whole can be made compact.

The operation of this embodiment will now be described.

The throttle wire 41 is drawn to open and close the butterfly throttle valve 7, and the slide valve 6 is opened and closed via the interlocking mechanism 9 in accordance with the opening and closing operations of the butterfly throttle valve 7. During this time, the vacuum does not work on the slide valve 6 directly to displace the valve in the downstream direction since the butterfly throttle valve 7 is provided on the downstream side of the slide valve 6. Accordingly, the frictional resistance between the outer surface of the slide valve 6 and the inner surface of the guide cylinder 24 is relatively small, and the throttle wire 41 can be operated by relatively small tractive force. Moreover, even when the engine is suddenly accelerated by suddenly increasing the degree of opening of the butterfly throttle valve 7, the slide valve 6 is opened accordingly. Therefore, the opening of the slide valve 6 is not delayed, and excellent acceleration can be obtained.

If the opening degree of the butterfly throttle valve 7 is set to a low level to carry out low-load operation of the engine, the discharge rate of the fuel from the low speed fuel nozzle 19 can be controlled in accordance with the opening degree of the butterfly valve 7 since the low speed fuel nozzle 19 is provided in the vicinity of the butterfly throttle valve 7. The control of the discharge rate of the fuel from the nozzle 19 can thus be made with high accuracy.

When the opening degree of the slide valve 6 is set to intermediate and high levels so as to carry out intermediate and high load operations of the engine, the slide valve 6 effects its function as a variable venturi, and the vacuum above the main fuel nozzle 10 is controlled in accordance with load thereby to regulate the discharge rate of the fuel from the main fuel nozzle 10. Thus, a fuel mixture suitable for intermediate and high load operation of the engine can be formed.

It is considered that, during a period of time in which a low-load operation of the engine is changed to an intermediate-load operation of the engine, the vacuum in the suction passage 1 does not increase in accordance with a sudden opening operation of the slide valve 6 in some cases. In such a case, the discharge rate of the fuel from the main fuel nozzle 10 could be at an insufficiently low level. If this occurs, the vacuum in the portion of the suction passage 1 which is between the butterfly throttle valve 7 and the slide valve 6 is higher than that in the portion of the suction passage 1 which is below the slide valve 6. Moreover, since the low and intermediate speed primary fuel nozzle 28 opens into the portion of the suction passage 1 which is between the butterfly throttle valve 7 and the slide valve 6, the fuel is discharged therefrom for compensating for the shortage of the fuel discharged from the main fuel nozzle 10.

Thus, an excellent air-fuel ratio can be obtained in all operational regions, i.e., from a low-load operational region to a high-load operational region.

Since the interlocking mechanism 9 operatively connecting the butterfly throttle valve 7 and the slide valve 6 together is arranged in the housing chamber 60, it is isolated from outside conditions of dirt and dust. Accordingly, abrasion and rusting of the constituent parts of the interlocking mechanis 9 can be substantially prevented and the durability thereof can be assured.

Figure 8:
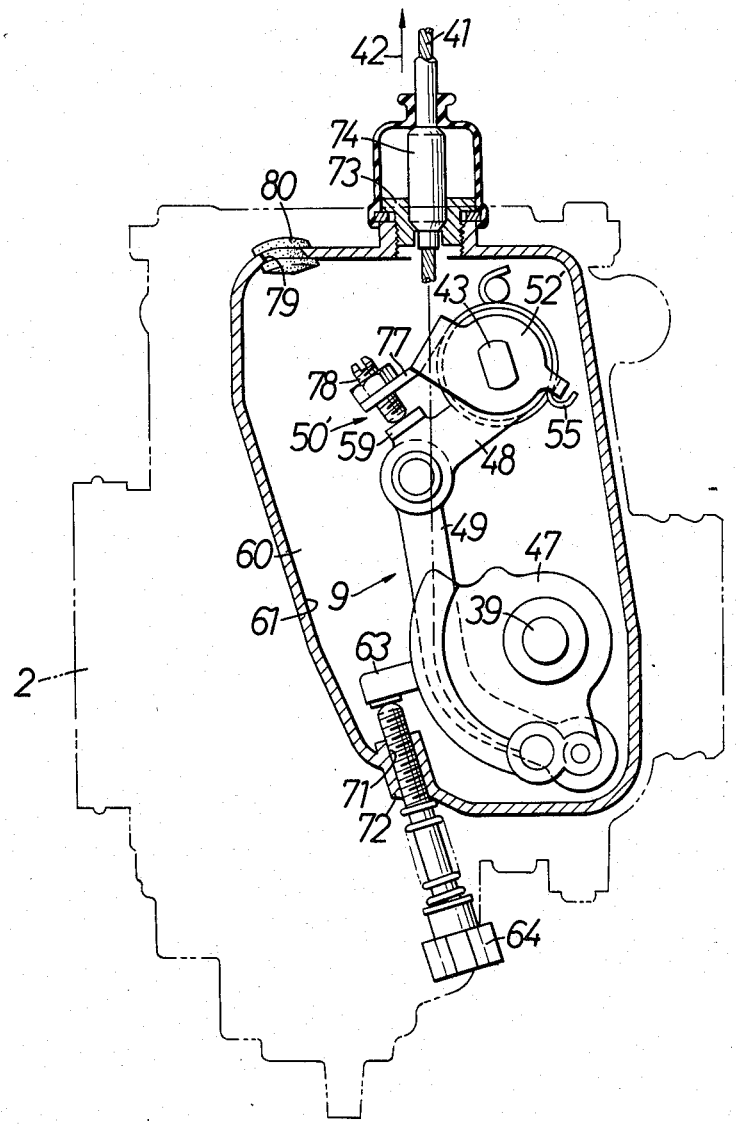
FIG. 8 is a sectional view, which corresponds to FIG. 5, of a second embodiment of the present invention.

FIG. 8 shows a second embodiment of the present invention. In FIG. 8, elements which are identical to those in the embodiment of FIGS. 1–7 are given the same reference characters and similar, but modified elements are represented with primes.

In FIG. 8 there is seen a lever 52' which is mounted on pivotable shaft 43 so that the lever 52' is angularly fixed relative to the shaft 43 and lever 52' is provided with an integral support projection 77. A screw 78 serving as a regulator member is engaged with the support projection 77 so that the screw 78 can be turned forwardly and backwardly to engage with and disengage from a projection 59 of a pivotable arm 48. These parts form a regulator mechanism 50'. An operating bore 79 is provided in the portion of a wall of a housing recess 61, a part of a housing chamber 60, or the cover member 62 which is aligned with the axis of the screw 78. The operating bore 79 is closed with a removable rubber cover 80. With such a construction, the screw 78 can be operated from the outside and be accommodated in the housing chamber 60.

Figure 9:
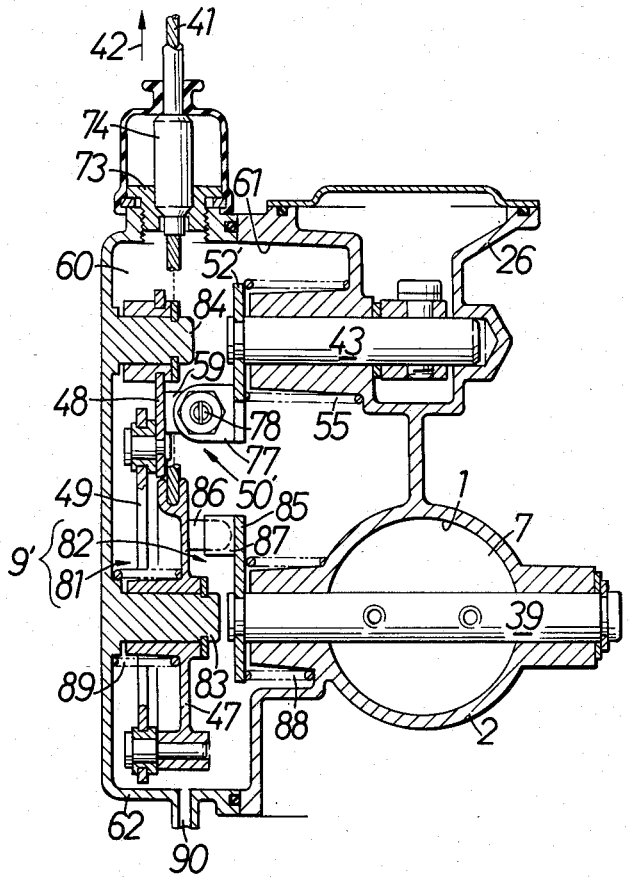
FIG. 9 is a front elevational view, in section, which corresponds to FIG. 6, of a principal portion of a third embodiment of the present invention.

FIG. 9 shows a third embodiment of the present invention. In FIG. 9, elements which are identical to those in the embodiment of FIGS. 1–7 are given the same reference characters and similar but modified elements are represented with primes.

In FIG. 9 there is seen interlocking mechanism 9' of a construction such that it can be divided into a portion 81 attached to cover member 62, and a portion 82 attached to carburetor body 2. The portion 81 comprises a throttle lever 47, connecting rod 49 and pivotable arm 48. The throttle lever 47 is supported pivotably on a support shaft 83 which is formed integrally with the cover member 62 so as to extend on an extension of the axis of valve shaft 39, and the pivotable arm 48 on a support shaft 84 which is formed integrally with the cover member 62 so as to extend on an extension of the axis of pivotable shaft 43. The portion 82 comprises a connecting arm 85 fixed to the valve shaft 39, and a lever 52' fixed to the pivotable shaft 43.

The throttle lever 47 and the connecting arm 85 are provided with respective projections 86,87, which are engaged with each other. The projections 86,87 are arranged in positions in which they can be engaged with each other when the cover member 62 is fastened to the carburetor body 2. Moreover, the connecting arm 85 and the throttle lever 47 are urged by coil springs 88,89, respectively, in the direction in which butterfly throttle valve 7 is closed. The projection 86 of the throttle lever 47 is so arranged that it is engaged with the projection 87 of the connecting arm 85 when the butterfly throttle valve 7 is opened.

The connection of the pivotable arm 48 and the lever 52' is made via the regulator mechanism 50' described previously and shown in FIG. 8, screw 78 being engaged with a projection 59 on the pivotable arm 48.

Since the interlocking mechanism 9' is formed so that it can be divided into the cover member-attached portion 81 and the carburetor body-attached portion 82, the mechanism 9' can be assembled when the cover member 62 is fastened to the carburetor body 2. This improves the assembling efficiency of the carburetor.

The cover member 62 may be provided with vent or breathing bore 90 at its lower portion whereat splashing of water is minimized.

Figure 10:
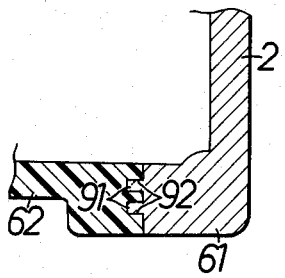
FIG. 10 is an enlarged sectional view of a principal portion of a fourth embodiment of the present invention.

FIG. 10 shows a fourth embodiment of the present invention, in which cover member 62 has a labyrinth seal structure, and is fitted in a free edge of a wall of housing recess 61. In this regard, the free edge of the wall of the housing recess 61 is provided with a plurality of locking projections 91, and the free edge of the cover member 62 is provided with locking grooves 92 in which the projections 91 are engaged. This construction enables a seal member to be omitted, so that the cover member 62 can be fastened to the carburetor body 2 more easily.

If the housing chamber 60 is formed by the wall of the housing recess 61 and the cover member 62 as in each of the above-described embodiments, the steps of forming the chamber can be simplified. Due to this formation of the housing chamber, the dimensions of the parts of the carburetor which project from the side portions thereof can be minimized. The housing chamber may also be formed by the cover member alone without providing the housing recess 61 on the carburetor body 2.

As seen from the description of the embodiments of the present invention, the slide valve and the butterfly throttle valve are connected together via the interlocking mechanism and thereby the slide valve can follow a sudden acceleration operation properly whereby the acceleration response of the slide valve can be improved.

Since the interlocking mechanism is arranged in the housing chamber, it is not exposed directly to the outside air, so that the durability of the mechanism can be assured.

Although the invention has been described in relation to specific preferred embodiments thereof, it will become apparent to those skilled in the art that numerous modifications and variations can be made without departing from the scope and spirit of the invention as defined in the attached claimed.

What is claimed is:

1. A variable venturi type carburetor comprising a carburetor body provided with a suction passage therein, a slide valve supported by said body for movement across said suction passage to function as a variable venturi, a butterfly throttle valve pivotably supported by said carburetor body downstream of said slide valve, an interlocking means connecting said slide valve and said butterfly throttle valve for operation in correspondence with one another, said carburetor body comprising a side portion including a wall defining a housing recess, and a cover member fixed to said carburetor body to close said housing recess and form a housing chamber in which said interlocking means is arranged, said cover member including an integral loosening-preventing portion, said interlocking means including a setting nut associated with said slide valve, said loosening-preventing portion engaging said setting nut for preventing turning thereof, thereby to prevent said setting nut from being loosened.

2. A variable venturi type carburetor as claimed in claim 1, wherein said interlocking means includes a regulator member, said wall being provided with a bore through which said regulator member is accessible for being operated.

3. A variable venturi type carburetor as claimed in claim 1, wherein said interlocking means includes an adjusting screw, said wall being provided with an integral boss in which said adjusting screw is engaged.

4. A variable venturi type carburetor as claimed in claim 1, wherein said carburetor body includes a guide cylinder in which said slide valve is slidably fitted, said butterfly throttle valve including a shaft, said interlocking means including a rotary shaft, said shaft of the butterfly throttle valve and said rotary shaft being supported in said housing chamber separated from said guide cylinder.

5. A variable venturi type carburetor as claimed in claim 1, comprising a bypass type starting fuel supply means mounted on said carburetor body opposite said side portion.

6. A variable venturi type carburetor as claimed in claim 1, wherein said housing chamber includes a lower wall which is provided with a breathing bore.

7. A variable venturi type carburetor as claimed in claim 1, wherein said interlocking means includes a first portion attached to said cover member, and a second portion attached to said carburetor body, said first portion and said second portion being coupled together when said cover member is secured to said carburetor body.

8. A variable venturi type carburetor as claimed in claim 1, wherein said cover member includes a labyrinth seal structure, said wall having a free edge portion engaged with said labyrinth seal structure.

9. A variable venturi type carburetor as claimed in claim 1, wherein said cover member consists of a flexible synthetic resin material resiliently engaged with a free edge portion of said wall.

10. A variable venturi type carburetor as claimed in claim 1, wherein said cover member is pivotably supported at a lower portion thereof on said carburetor body, and fixed at an upper portion thereof to said carburetor body.

11. A variable venturi type carburetor as claimed in claim 1, comprising a throttle wire for operating said interlocking means supported on a wall of said housing chamber.

12. A method of operating a variable venturi type carburetor having a carburetor body provided with a suction passage therein, a slide valve supported by the body for movement across the suction passage to function as a variable venturi and a butterfly throttle valve pivotably supported by the carburetor body downstream of the slide valve, said method comprising connecting said slide valve and said butterfly throttle valve for operating in correspondence with one another by an interlocking mechanism, mounting the interlocking mechanism at a side of the carburetor body outside said suction passage, securing a cover member on the carburetor body to enclose said interlocking mechanism in a housing chamber, regulating the interlocking mechanism by a regulator mechanism from outside said housing chamber to regulate the relative opening positions of the slide valve and butterfly throttle valve, securing a part of the interlocking mechanism which is regulated by the regulator mechanism in the housing chamber by a setting nut of the interlocking mechanism, and engaging the setting nut by an integral loosening-preventing portion on the cover member, when the cover member is secured on the carburetor body, to prevent the setting nut from being loosened and separated from the interlocking mechanism.

13. A method as claimed in claim 12 comprising coupling together a first portion of the interlocking mechanism attached to the cover member to a second portion of the interlocking mechanism attached to the carburetor body when said cover member is secured to the carburetor body.

* * * * *